United States Patent [19]

Hehl et al.

[11] 4,231,411

[45] Nov. 4, 1980

[54] ROLLER-BLIND ASSEMBLY

[75] Inventors: Klaus Hehl, Remscheid-LUM/u/ttringhausen; Hans-Jürgen Sauer, Remscheid, both of Fed. Rep. of Germany

[73] Assignee: Riloga-Werk Joachim Schmidt, Remscheid, Fed. Rep. of Germany

[21] Appl. No.: 707,452

[22] Filed: Jul. 21, 1976

[30] Foreign Application Priority Data

Jul. 22, 1975 [DE] Fed. Rep. of Germany ..... 2532622

[51] Int. Cl.[2] ..... E06B 9/08

[52] U.S. Cl. ..... 160/120; 160/241; 160/310

[58] Field of Search ..... 160/19, 38, 120, 241, 160/310

[56] References Cited

U.S. PATENT DOCUMENTS

| | | | |
|---|---|---|---|
| 642,423 | 1/1900 | Brodie | 160/120 |
| 1,885,766 | 11/1932 | Ridpath et al. | 160/310 |
| 1,988,666 | 1/1935 | Sandell | 160/310 |
| 3,389,738 | 6/1968 | Roth | 160/241 |
| 3,574,887 | 4/1971 | Schindlauer | 160/19 |
| 3,983,600 | 10/1976 | Smith | 160/38 |

FOREIGN PATENT DOCUMENTS

| | | | |
|---|---|---|---|
| 382757 | 3/1922 | Fed. Rep. of Germany | 248/307 |
| 2237455 | 2/1974 | Fed. Rep. of Germany | 160/38 |

*Primary Examiner*—Peter M. Caun

*Attorney, Agent, or Firm*—Michael J. Striker

[57] ABSTRACT

A roller-blind assembly comprises a plurality of roller blinds each windable about a respective shaft having a pair of ends. A plurality of mounting assemblies are provided some of which enclose mechanism for operating the blinds and some of which merely act as support bearings for the ends of the shaft. In addition these housings which are all identical are formed at their front and rear sides with slots in which are engageable flanges of adapters that can secure a continuous cover plate over a plurality of such housings to mask the roller blinds supported thereon. A plurality of axially aligned such housings may be secured via adjustable clamps to a ceiling-mounted rail that in turn is formed with a flange carrying the cover plate.

8 Claims, 4 Drawing Figures

ROLLER-BLIND ASSEMBLY

CROSS-REFERENCE TO RELATED APPLICATION

This application is related to copending and commonly assigned patent application Ser. No. 705,384 filed July 15, 1976 by K. Hehl.

BACKGROUND OF THE INVENTION

The present invention relates to a roller blind. More particularly this invention concerns such a blind which is suspended from a wall or ceiling above a window aperture or the like.

It is known to suspend a roller blind, by which is meant either a slat-type blind, a window-shade arrangement or the like above or adjacent an aperture to be covered by the blind. A mechanism is provided such as described in the above-identified copending application whose entire disclosure is herewith incorporated by reference for winding and unwinding the blind from a rod and for positioning it relative to the aperture to be covered. It is noted that such an assembly can also be used for any raisable or lowerable screen, map or the like.

The most common prior-art arrangement of a window blind or the like uses mechanism inside the rod about which the blind is windable in order to position this blind. Such mechanism is frequently failure-prone and can only be used to operate relatively light blinds whose length does not exceed a predetermined maximum. Each of the known window blinds must have at each end a mounting member so that if a plurality of such blinds are to be installed next to each other in front of a relatively large window or the like it is necessary to provide two mounting brackets for each of the blinds. This requires careful positioning of these brackets in order accurately to align the blinds and present the most attractive appearance. Nonetheless the finished assembly is fully exposed and, indeed, often considered rather unattractive.

A similar disadvantage prevails with the known type of arrangements wherein mounting units are provided at each end of the roller blind. The user must decide whether he or she chooses to operate the blind from the right-hand or left-hand mounting unit and must buy the correspondingly constructed unit. Thereafter it is necessary to provide a dummy or idler unit for the other end, once again using two mounting units for each blind. The overall assembly has the unattractiveness described above with reference to the lighter-duty window blinds so that it is often necessary to provide a totally separate valence or the like to cover the mechanisms.

SUMMARY OF THE INVENTION

It is therefore an object of the present invention to provide an improved roller-blind assembly.

Another object is the provision of an improved roller blind which incorporates the mechanism described in the above-cited copending patent application and which overcomes the above-given disadvantages of the prior-art arrangement.

Yet another object is to provide such a blind which can be installed relatively easily and which has an attractive appearance once installed.

A further object of this invention is the provision of a roller-blind assembly with which it is possible to mount a plurality of roller blinds next to one another and to control the roller blinds from either the right or the left sides.

These objects are attained according to the present invention in an assembly of the above-described general type wherein the blind is rolled about a shaft which is rotatably supported at each of its ends in a hollow housing. These housing are identical and one of them enclosed mechanism as described in the above-cited copending patent application to operate the blind. Thus it is possible to provide this mechanism in either of the houses for right-hand or left-hand control of the blind.

According to another feature of this invention the housing incorporating the mechanism has on one side a socket or stub shaft that is connected to the mechanism and serves to drive the one blind and has on its opposite side and axially aligned therewith an idler bearing for receiving the end of another blind aligned with the blind controlled by the mechanism in the housing. It is also possible in accordance with this invention to provide in the housing mechanism for controlling the blinds on both sides of the housing, or to provide on both sides of the housing an idler bearing for two separate shaft ends.

In accordance with another feature of this invention the housing is provided at its front and at its rear with a formation adapted to receive a connecting portion of a cover plate or of an adapter that can also be connected to a cover plate. Thus the entire assembly of several roller blinds can be held behind the decorative cover plate that screens all of the mechanism in the various mounting units. Such a cover plate can readily be cut to the desired length and mounted on a plurality of such axially aligned housings by even an unskilled worker.

In accordance with yet another feature of this invention the formations are constituted as forwardly and rearwardly open slits extending parallel to the rotation axis of the blind at the upper region of the front and back of the housing. This increases the ways in which the housing can be mounted and makes it easy to position the cover plate thereon.

According to yet another feature of the present invention a support rail or mounting rail is provided which extends past a plurality of such roller-blind assemblies. The housings are all secured via adjustable clamps to this rail. These clamps are adjustable in that the housings can be slid along the rail both parallel to it and limitedly transverse to it for exact positioning of the roller blinds. With such a rail the cover plate may be clipped to the rail, in which case the rail in effect acts as a mounting adapter.

It is therefore possible in accordance with the present invention to mount a plurality of roller blinds in line, using only one more mounting unit than the number of roller blinds. Only the end mounting units serve for the journalling of only one roller blind, the intermediate units each serving to carry two shaft ends of adjacent roller blinds. Once the housings are mounted it is possible to provide the mechanism in whichever housing it is desired to control the respective blind from. Thereafter the cover plates can be snapped easily on to cover the entire arrangement and give an attractive appearance to it.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
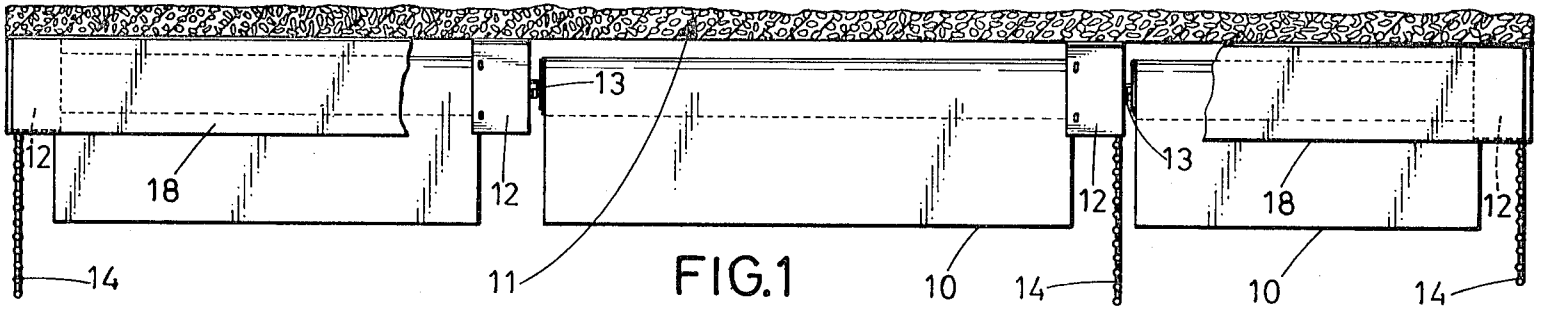
FIG. 1 is a side partly sectional view showing a ceiling-mounted roller-blind assembly.

As shown in FIG. 1 a plurality of window-shade blinds 10 windable about respective shafts 13 are secured to a ceiling 11 via mounting units 12.

Three of these four units 12 incorporate mechanism 30 such as described in the above-cited patent application that is operable by means of ball chains 14. In the arrangement shown in FIG. 1 the center and right-hand blinds 10 are operated from the right-hand units 12 and the left-hand blind 10 is operated from the left-hand unit. Thus the second-from-left unit 12 merely acts as an idler and does not have any operating mechanism in it. The user, therefore, need merely buy as many operating mechanisms as blinds 10, and the necessary number of housings 12. If the blinds are all to be mounted in a row as shown in FIG. 1, one more housing 12 need be bought than blind 10. In addition for each roller blind a small idler clip such as shown at 38 in FIG. 4 may be secured to the side of one of the housings 12 via screws fitting into the holes shown at 15. Each drive mechanism 30 has a hexagonal shaft indicated here at 26 in FIG. 4 and shown at 20 in FIG. 5 of the above-cited copending patent application. It is therefore possible to form virtually any type of system with only a few basic parts that can be combined in virtually any manner.

Figure 2:
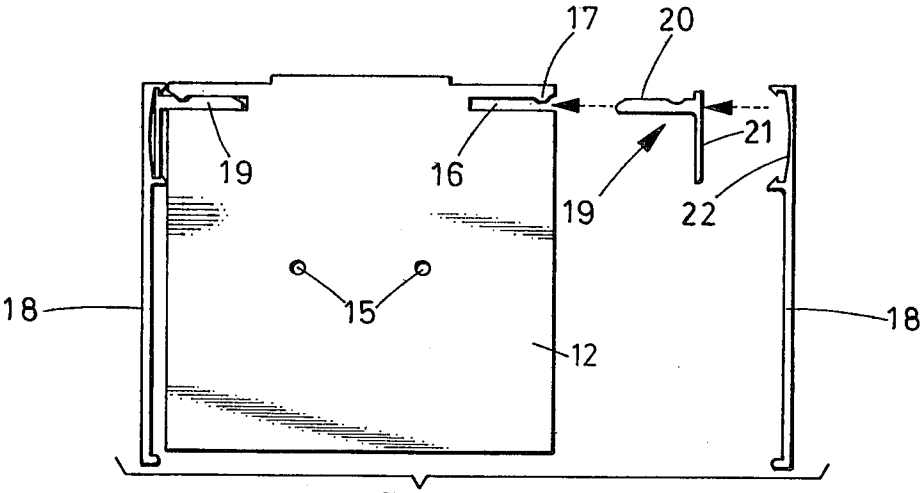
FIG. 2 is an end partly exploded view illustrating the assembly of the arrangement of FIG. 1.

Furthermore each of the housings is formed as shown in FIG. 2 immediately beneath its top side at both its front and its back with a horizontally extending slot 16 formed with a downwardly directed ridge 17. The housings 12 are made of limitedly resiliently deformable material such as aluminum so that the upper part of the housing above the slot 16 can be deflected upwardly. Thus it is possible to mount an elongated cover plate 18 by means of an adapter 19 in the slot 16. This adapter 19 is generally L-shaped and has a horizontal flange 20 of shape complementary to that of the slot 16 and a vertical flange 21 receivable in a correspondingly shaped groove 22 of the cover plate 18. One of these adapters 19 is provided at each of the housings 12 and a single cover plate 18 cut to the desired size is connected to all of them so that one cover plate of attractive appearance covers a multiblind assembly. The plate 18 may be of decorative synthetic-resin or metallic material and can be cut to length by the user with considerable ease. It is also noted in this respect that since the blinds 10 do not have any mechanism themselves it is a relatively simple manner for the user to cut them also to length. It should also be pointed out that one side wall of each of the housings 12, the left-hand side as seen in FIG. 1, is recessed.

Figure 3:
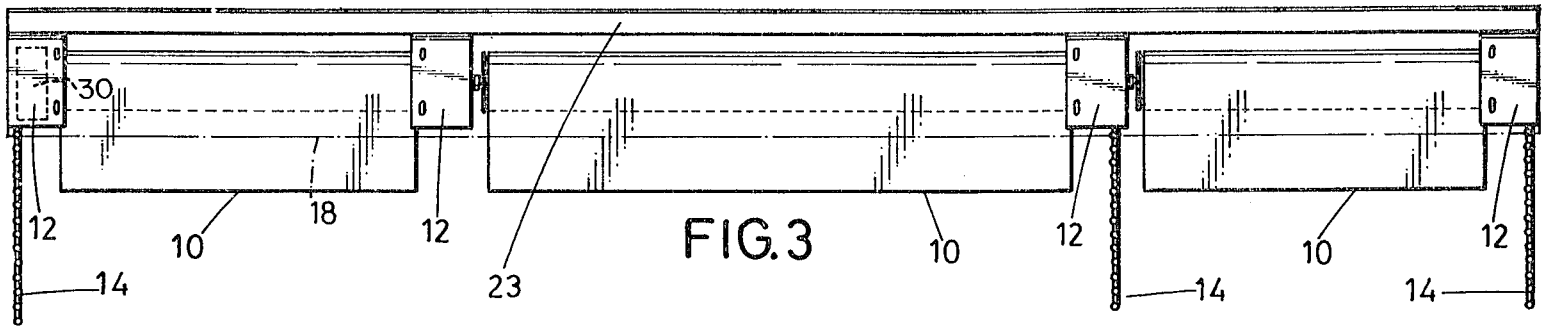
FIG. 3 is a view similar to FIG. 1 showing the use of a mounting rail.
Figure 4:
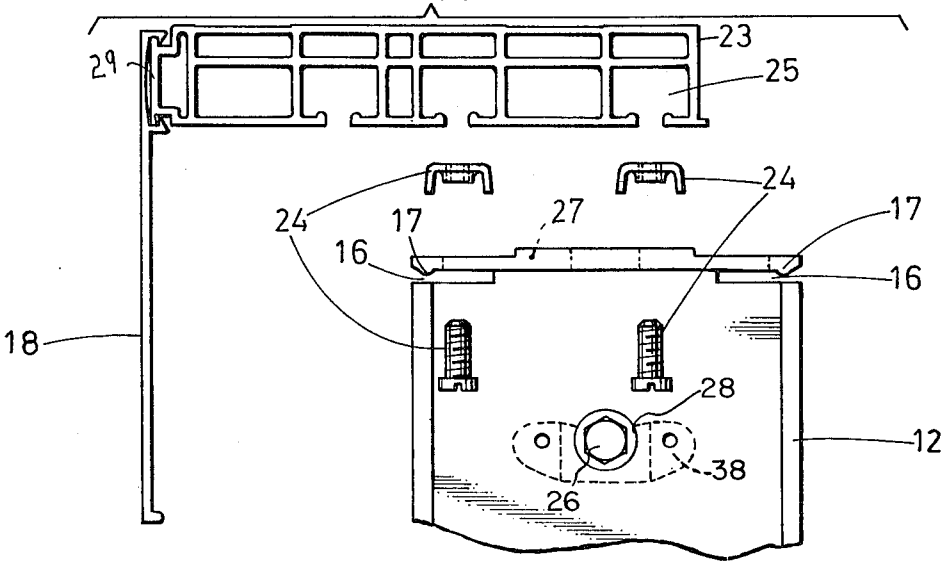
FIG. 4 is an end partly exploded view illustrating the assembly of the arrangement of FIG. 3.

The housings 12 can all be secured as shown in FIGS. 3 and 4 to a common ceiling-mounted rail 23 formed with longitudinally extending grooves 25 adapted to receive connectors 24 constituted by nuts receivable in the groove 25 and screws engageable through transversely extending slots in the upper wall of the housing 12 with these nuts. The slots 25 are formed with apertures that allow the nuts of the clamps 24 to be slipped into them and then slid along to the appropriate position. It is also noted that the slots 27 formed in the top of the housing are formed at the recessed side wall thereof so that these slots 27 are accessible from outside the housing. Of course it is possible for the shaft 26 to extend from the hole 28 in either side of the housing. The particular construction of the brake as described in the above-cited application allows the operating mechanism to function in either direction, as no conventional ratchet or pawl arrangement is provided so that this mechanism can extend in either direction and be operated both ways.

Furthermore FIG. 4 indicates how the front edge of the rail 23 is formed with a flange 29 receivable within the groove 22 of the cover plate 18. It is also possible to mount this cover plate 18 on the housings 12 via the slots 16 as described with reference to FIG. 2.

In practice it has been found most convenient to supply housings 12 provided with mechanisms for operating the blinds, empty housings 12 and to provide idler bearings for securing to the holes 15 separately. Thus the user need merely buy the appropriate number of mounting units and end bearings and can very easily assemble the system he or she desires.

It will be understood that each of the elements described above, or two or more together, may also find a useful application in other types of assemblies differing from the types described above.

While the invention has been illustrated and described as embodied in a roller-blind assembly, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A roller-blind assembly comprising:

two axis-defining shafts each having a pair of ends;

a blind rollable about each of said shafts between its said ends;

three identical hollow housings at and rotatably supporting said ends of said shafts, each of said housings having a pair of opposite axially spaced sides, one of said housings supporting with each of its said sides one end of each of said shafts and the other two housings each supporting with a respective one of their said sides the other end of each of said shafts, each of said housings being formed with a pair of horizontally oppositely open slots;

mechanism inside each of two of said housings each for rotating a respective one of said shafts independently of the other shaft about its axis and thereby winding and unwinding the respective blind; and a cover plate extending axially along all of said housings and next to both of said blinds and having portions engaged in one of said pair of slots of each of said housings.

2. The assembly defined in claim 1, further comprising connecting elements constituting at least some of said portions and engageable with said cover plates and in said slots with said housings.

3. The assembly defined in claim 2, wherein each of said portions has a tongue-like tab engageable in one of said slots.

4. The assembly defined in claim 3, further comprising mounting rails and mounting members connecting said housings to said rails.

5. The assembly defined in claim 4, wherein said mounting members are adjustable clamps.

6. The assembly defined in claim 1, wherein each of said housings is constituted at least at its said slots of limitedly elastically deformable material and each of said slots is internally formed with an inwardly directed ridge, each of said portions having an outwardly directed groove interfittable with a one of said ridges.

7. The assembly defined in claim 6, wherein each of said housings is generally box-shaped.

8. The assembly defined in claim 1, wherein each of said housings is provided with a journal arranged at each of said sides and adapted to receive an end of the respective shaft, said journals on opposite sides of said housing being axially in line.

* * * * *

UNITED STATES PATENT AND TRADEMARK OFFICE

CERTIFICATE OF CORRECTION

PATENT NO. : 4,231,411

DATED : November 4, 1980

INVENTOR(S) : Klaus Hehl et al.

It is certified that error appears in the above-identified patent and that said Letters Patent are hereby corrected as shown below:

In the heading, the name of the assignee should read -- Riloga-Werk Julius Schmidt --.

Signed and Sealed this

*Seventeenth* Day of *March 1981*

[SEAL]

*Attest:*

RENE D. TEGTMEYER

*Attesting Officer*

*Acting Commissioner of Patents and Trademarks*